US010352030B2

(12) United States Patent
Le

(10) Patent No.: US 10,352,030 B2
(45) Date of Patent: Jul. 16, 2019

(54) TOILET HYDRAULIC SYSTEM

(71) Applicant: FLUIDMASTER, INC., San Juan Capistrano, CA (US)

(72) Inventor: Tuan Le, Fountain Valley, CA (US)

(73) Assignee: FLUIDMASTER, INC., San Juan Capistrano, CA (US)

( * ) Notice: Subject to any disclaimer, the term of this patent is extended or adjusted under 35 U.S.C. 154(b) by 135 days.

(21) Appl. No.: 15/564,718

(22) PCT Filed: Mar. 7, 2016

(86) PCT No.: PCT/US2016/022195
§ 371 (c)(1),
(2) Date: Oct. 5, 2017

(87) PCT Pub. No.: WO2016/153772
PCT Pub. Date: Sep. 29, 2016

(65) Prior Publication Data

US 2018/0112383 A1 Apr. 26, 2018

Related U.S. Application Data

(60) Provisional application No. 62/128,870, filed on Mar. 5, 2015.

(51) Int. Cl.
*E03D 11/02* (2006.01)
*E03D 11/18* (2006.01)

(52) U.S. Cl.
CPC ..... *E03D 11/02* (2013.01); *E03D 11/18* (2013.01); *E03D 2201/30* (2013.01)

(58) Field of Classification Search
CPC ..... E03D 11/02; E03D 11/08; E03D 11/18; E03D 11/06

(Continued)

(56) References Cited

U.S. PATENT DOCUMENTS 3,131,402 A 5/1964 Roberts
3,224,013 A * 12/1965 Tubbs ..... E03D 3/00 4/425

(Continued)

FOREIGN PATENT DOCUMENTS

WO 2016153772 A1 9/2016

OTHER PUBLICATIONS

U.S. Patent and Trademark Office; PCT International Search Report, Issued in Connection to PCT/US2016/021195; dated May 19, 2016; 2 pages; U.S.

(Continued)

*Primary Examiner* — Lauren A Crane
(74) *Attorney, Agent, or Firm* — Greenberg Traurig, LLP

(57) ABSTRACT

A toilet having a tank to receive water and a bowl connected with the tank. Water travels from the tank to the bowl to discharge waste in the bowl through a manifold connected to the bowl and into a drain line. The toilet has a jet trapway portion having a jet inlet with a nozzle connected with the tank. The nozzle directs water from the jet inlet to overcome an upward bend in the jet trapway portion until received by the manifold at an inlet below the upward bend. A waste trapway portion extends from the manifold opposite the jet trapway portion and connects with the drain line. Waste is discharged from the bowl through the manifold over a bend in the waste trapway portion by combining water flowing from the jet trapway portion into the manifold with waste flowing from the manifold into the waste trapway portion.

24 Claims, 9 Drawing Sheets

(58) Field of Classification Search
USPC ..... 4/421, 425, 422
See application file for complete search history.

(56) References Cited

U.S. PATENT DOCUMENTS

| | | | | |
|---|---|---|---|---|
| 4,462,124 | A | 7/1984 | Antos et al. | |
| 5,515,556 | A * | 5/1996 | Johnson | E03D 5/00 4/421 |
| 5,666,675 | A | 9/1997 | Ruegg | |
| 2008/0060122 | A1 | 3/2008 | Andreiu | |
| 2010/0043130 | A1* | 2/2010 | Grover | E03D 11/02 4/324 |
| 2012/0198610 | A1 | 8/2012 | Mchale et al. | |
| 2012/0284910 | A1 | 11/2012 | Shirakawa et al. | |

OTHER PUBLICATIONS

U.S. Patent and Trademark Office; PCT Written Opinion of the International Searching Authority, Issued in Connection to PCT/US2016/021195; dated May 19, 2016; 7 pages; U.S.

* cited by examiner

TOILET HYDRAULIC SYSTEM

RELATED APPLICATION

This application is the 35 U.S.C. § 371 national application of International Patent Application No. PCT/US2016/021195, filed Mar. 7, 2016, which designated the United States and claimed priority to U.S. Provisional Patent Application No. 62/128,870, filed on Mar. 5, 2015, and entitled "Modified Trapway and Flushing System," the disclosures of which are incorporated by reference in their entirety.

TECHNICAL FIELD

The present disclosure relates generally to toilets and flushing systems designed to discharge and dispose of liquid and solid waste and more specifically, siphonic and jet-powered siphonic toilets and related flushing systems.

BACKGROUND

Conventional toilets typically have a tank and a bowl. Each of the tank and/or the bowl can be distinct features attached to each other or they can be integrally formed as one single apparatus. With respect to the tank, it has been known to be situated above the bowl in some manner and typically disposed towards the rear portion of the bowl itself. The tank is designed to store liquids that can be later used for activating a flush of the bowl in order to remove contents including liquid and solid waste deposited in the bowl.

Activation of a flush causes the contents in the bowl to be delivered to a drain line in communication with the bowl itself. To activate a flush, the user may depress a button or flush lever externally positioned on the tank causing a flush valve positioned inside the tank to release water into the bowl. With this in mind, it is important to understand what may be achieved through activation and completion of a particular flush cycle. Primarily, liquid and solid waste is removed from the bowl. Additionally, the flush cycle causes the bowl to be cleaned from the waste previously stored therein including any particulate which may have adhered or otherwise lodged to the inner portion of the bowl.

In gravity fed toilets that utilize a siphon during the flush cycle, the toilet is designed so that a syphon is typically formed in the trapway of the toilet when water is added to the bowl. More specifically, the trapway may have a U-shaped tube that draws water from the bowl to the drain line. In practice, however, flush activation may cause water in the tank to travel into the bowl and spill over the highest point in the trapway at a rate greater than the water can exit the trapway into the drain line.

At some point enough air in the trapway is removed in a manner that activates the siphon effect in the trapway thereby causing any remaining liquids in the bowl to be drawn to the drain line. Consequently, because most of the air must be removed from the portion of the trapway closer to the drain line to initiate a siphon, conventional toilets usually utilize trapways with relatively small diameters. However, reducing the diameter of the trapway can lead to clogging of waste inside the trapway.

In recent years, gravity-fed siphoned toilets have improved their capability of disposing of waste through siphon jets using rim-jet designs or direct-jet designs. In a rim-jet design approach, activation of a flush causes water to travel from the tank through an inlet of the bowl and through a manifold leading to a channel of the toilet rim. In this respect, the water from the tank may be delivered onto and/or around the bowl's perimeter through one or more apertures of the bowl under the rim. During a flush, the tank also delivers water through a jet disposed on the rim. This rim-jet is connected to the bowl and its relative opening is typically characterized to deliver water directly at the opening in the trapway. In rim-jet designs, water flows through the jet in a manner that fills the trapway of the toilet quicker than with toilets lacking the rim-jet. Because the rim-jet increases the rate of flow for the water to the trapway, the trapway is no longer limited by trapway diameter as previously discussed. This has been advantageous in overcoming the previously-referenced clogging of accumulated waste in trapways.

Direct-jet designs similarly send water from the tank to the inlet of the bowl and through the manifold. However, this water is divided by the design into a first portion directed towards the inlet of the rim to clean the bowl whereas a second portion is directed through a direct-jet that is coupled to the manifold. This direct-jet can be dimensioned in a manner to deliver water directly at the opening of the trapway at desired flow rates. Accordingly, water delivered from the direct-jet to the trapway causes the trapway to likewise be filled quickly.

Both rim-jet and direct-jet designs suffer in several notable manners. For one, because water has grown increasingly scarce, there remains a constant need in the industry to develop flush systems that increase flush efficiency that in turn consume fewer gallons per flush. In this race towards efficiency, there also exists a need to optimize respective jet and trapway design without sacrificing performance including cleanliness of the bowl or total manufacturing costs. There also exists a need to produce a flushing system that is easy to install and maintain to conserve vital labor costs. There also exists a need to resolve issues with unplanned backflow of dark water into the tank in order to both protect architecture inside the tank as well as well as to maintain low system maintenance costs. Finally, there exists a need for siphon flush systems that draw upon direct-jet and/or rim-jet designs that avoid trapway clogging while also maintaining compliance with relevant field standards and regulations.

SUMMARY

The following simplified summary is provided in order to provide a basic understanding of some aspects of the claimed subject matter. This summary is not an extensive overview, and is not intended to identify key/critical elements or to delineate the scope of the claimed subject matter. Its purpose is to present some concepts in a simplified form as a prelude to the more detailed description that is presented later.

In some embodiments, a hydraulic flushing system for a toilet is provided, the system preferably comprising a jet trapway portion, manifold, and waste trapway portion. The jet trapway portion may have an inlet with a nozzle fluidly communicable with a tank of the toilet. The nozzle may be designed to direct water from the inlet to overcome a bend in the jet trapway portion. The bend may be an upward bend and may be shaped as an upright U-shaped member, or substantially upright U-shaped member (e.g. tilted or angled but still oriented to direct fluids inside the jet trapway portion above a starting position). The manifold may receive the jet trapway portion at an inlet below the bend of the jet trapway portion. The manifold may be sealably connectable to a toilet bowl of the toilet. A waste trapway portion may extend away from an outlet of the manifold opposite the jet trapway portion (e.g. opposite the inlet receiving the jet trapway portion) and may be fluidly communicable with a drain line downstream of the toilet. In this respect, any contents in the bowl including waste may flow from the bowl into the manifold through the drain line and terminating in the sewage line.

In turn, contents such as waste may be discharged from the bowl through the manifold by combining siphon-induced water flowing into the manifold from the jet trapway portion with waste flowing from the manifold into the waste trapway portion. This combined water and contents flow may be strong enough to overcome a bend in the waste trapway portion that may be positioned above the waste outlet of the manifold. The jet trapway portion, the manifold, and the waste trapway portion may be integrally formed with each other to form a uniform, trapway system or one or more of the components may be removably attachable in a modular approach where each can be replaced as needed or required.

The trapway system may preferably be constructed from resilient or pliable plastic. The waste trapway portion may comprise multiple channels including a primary channel for discharging waste. At least one secondary channel may also be included for discharging liquids, wherein the at least one secondary channel may be smaller than the primary channel in dimensions such as diameter, cross section, relevant volume, or the like. The primary and secondary channels may be partially connected through a slit or an auxiliary outlet operable to obstruct solid waste or colloids but permit ingress of liquids. In this respect, the primary and secondary channels may be integrally formed with each other.

In some embodiments of the jet trapway portion, its nozzle may comprise a fastener with multiple seals that hermetically seal with the toilet tank. Preferably, the fastener may be an internally sealed female connector with one or more hose clamps, wherein the female connector is received by a corresponding male connector on the lower portion of the toilet tank. Optionally, the fastener may be integrally formed with the jet trapway portion.

In some embodiments of the waste trapway portion, a distal end of the waste trapway portion may comprise a fastener with multiple seals to hermetically seal with the drain line. Preferably, the fastener may be a male connector with one or more seals externally positioned so that the fastener may be insertably received by a female receiver of the drain line. The fastener may be insertably received by wax ring and/or a waste flange seated atop the drain line. Optionally, the fastener of the waste trapway portion may be integrally formed with the waste trapway portion.

In some embodiments, the manifold may comprise an upper portion and a closed lower portion. The upper portion may be designed to sealably connect with a lower portion of the toilet bowl. The closed lower portion may communicate with the upper portion through one or more perimetral walls of the manifold, wherein the closed lower portion may likewise have the inlet that receives the jet trapway portion and the outlet of the waste trapway portion.

The bend of the jet trapway portion may be formed in a first generally upward loop having one or more air locks that retain water from draining into the manifold. These airlocks may occupy less volume than may be available inside the jet trapway portion itself. The first generally upward loop may preferably be a U-shaped member. The jet trapway portion may also comprise one or more additional generally upward loops (which may be U-shaped members), wherein each additional loop may comprise a bend positioned above the inlet to the manifold. Each loop may likewise comprise one or more air locks associated with a respective loop to retain water from draining into the manifold.

The jet trapway portion may also comprise a ventilation tube that extends from the first upward loop, the ventilation tube being in fluid communication with the one or more air locks therein. The ventilation tube may be integrally formed with or preferably, may be removably attached to the first generally upward loop at the its bend. A proximal portion of the ventilation tube may be positioned adjacent to the first generally upward loop and a distal portion of the ventilation tube may be in communication with ambient air.

In other embodiments, a method is provided for flushing a jet-powered toilet with the herein disclosed trapway system. The method comprises: sealably connecting a manifold of the trapway system to a lower portion of a toilet bowl; mounting a jet trapway portion of the trapway system to a toilet tank, the jet trapway portion having a jet inlet with a nozzle in fluid communication with the toilet tank to supply water to the jet trapway portion during a flush cycle; directing water from the jet inlet of the jet trapway portion to overcome a bend in the jet trapway into an inlet of the manifold disposed below the bend; and discharging waste from the bowl through the manifold to a drain line through a waste trapway portion of the trapway system.

It should be noted that any of the herein described embodiments of the jet trapway portion, the waste trapway portion, and the manifold may be used in the disclosed method as need or required. Likewise, the manifold may receive waste from the toilet bowl, wherein the siphon-induced water flowing from the jet trapway portion and waste flowing from the bowl into the manifold are combined by orienting flow from the jet trapway portion directly at the outlet of the manifold. It should be noted that waste flows from the bowl and is typically discharged through the outlet of the manifold.

In those embodiments where the waste trapway portion comprises multiple channels, the method further comprise: discharging solid and liquid waste through the primary channel, wherein colloids and/or solid waste is obstructed by the slit from entering the at least one secondary channel; and discharging substantially only water and/or liquid waste through the at least one secondary channel.

Another jet-powered flushing system is also provided including a tank operable to receive water, a bowl in communication with the tank, wherein water is delivered from the tank to the bowl to discharge waste in the bowl through a manifold operatively connected to the tank and ultimately into a drain line. A jet trapway portion may include a jet inlet with a nozzle in fluid communication with the tank of the flushing system. The nozzle may direct water from the tank through the jet inlet to overcome a bend in the jet trapway portion. In this respect, the jet trapway portion may be received by the manifold at an inlet below the bend of the jet trapway portion. A waste trapway portion may extend away from an outlet of the manifold opposite the jet trapway portion and be in fluid communication with the drain line.

It should be noted that any of the herein described embodiments of the jet trapway portion, the waste trapway portion, and the manifold may be used in the disclosed jet-powered flushing system as need or required. The tank of the toilet may optionally be separated into first and second compartments by a partition. The first compartment may be capable of storing water to complete a flush cycle. Accordingly, the first compartment may have a flush valve to deliver water to the bowl during the flush cycle, and a fill valve to refill the tank. By contrast, the second compartment may be in fluid communication with the jet trapway portion, the second compartment comprising a jet intake to distribute water in the second compartment to the jet trapway portion.

The fill valve of the first compartment may close and prevent further filling at a predetermined level defined by a height in the tank above an upper portion of the partition. The jet intake may therefore be a tube or hose oriented generally upward and preferably, an upright U-shaped member having an inlet disposed adjacent to a lower surface of the tank.

The bend of the jet trapway portion may be formed by a first generally upward loop having one or more air locks to retain water from draining into the manifold. As such, the jet trapway portion may have a ventilation tube that extends from the first generally upward loop and is in fluid communication with the one or more air locks. Optionally, the ventilation tube may extend from the jet trapway portion until operatively connecting to an inlet of the first generally upward loop (e.g. the upright U-shaped member).

In this embodiment, it is preferably for the ventilation tube to pass through an air manifold that may be positioned adjacent to, nearby, or on an upper portion of the partition in the tank. A proximal portion of the ventilation tube may be adjacent to the first generally upward loop and a distal portion of the ventilation tube may be in communication with an ambient air aperture of the air manifold. The ambient air aperture of the air manifold may preferably be disposed in the first compartment or optionally in the second compartment.

In certain embodiments, the jet trapway portion may have one or more additional generally upward loops, each loop each having a bend above the inlet to the manifold and one or more associated air locks in communication with an associated ventilation tube extending from associated generally upward loops to retain water from draining into the manifold.

To the accomplishment of the foregoing and related ends, certain illustrative aspects are described herein in connection with the following description and the annexed drawings. These aspects are indicative, however, of but a few of the various ways in which the principles of the claimed subject matter may be employed and the claimed subject matter is intended to include all such aspects and their equivalents. Other advantages and novel features may become apparent from the following detailed description when considered in conjunction with the drawings.

DETAILED DESCRIPTION

The features of the presently disclosed solution may be economically molded or assembled by using one or more distinct parts and associated components which, may be assembled together for removable or integral application with a known or to-be-designed toilet flushing systems in an economical manner, wherein the features of the present disclosure may form the herein disclosed servicing apparatus regardless of the particular form. Unless defined otherwise, all terms of art, notations and other scientific terms or terminology used herein have the same meaning as is commonly understood by one of ordinary skill in the art to which this disclosure belongs.

In some cases, terms with commonly understood meanings are defined herein for clarity and/or for ready reference, and the inclusion of such definitions herein should not necessarily be construed to represent a substantial difference over what is generally understood in the art. All patents, applications, published applications and other publications referred to herein are incorporated by reference in their entirety. If a definition set forth in this section is contrary to or otherwise inconsistent with a definition set forth in the patents, application, published applications and other publications that are herein incorporated by reference, the definition set forth in this section prevails over the definition that is incorporated herein by reference.

As used herein, "a" or "an" means "at least one" or "one or more." As used herein, the term "user", "subject", "end-user" or the like is not limited to a specific entity or person. For example, the term "user" may refer to a person who uses the systems and methods described herein, and frequently may be a field technician. However, this term is not limited to end users or technicians and thus encompasses a variety of persons who can use the disclosed systems and methods.

Figure 1:
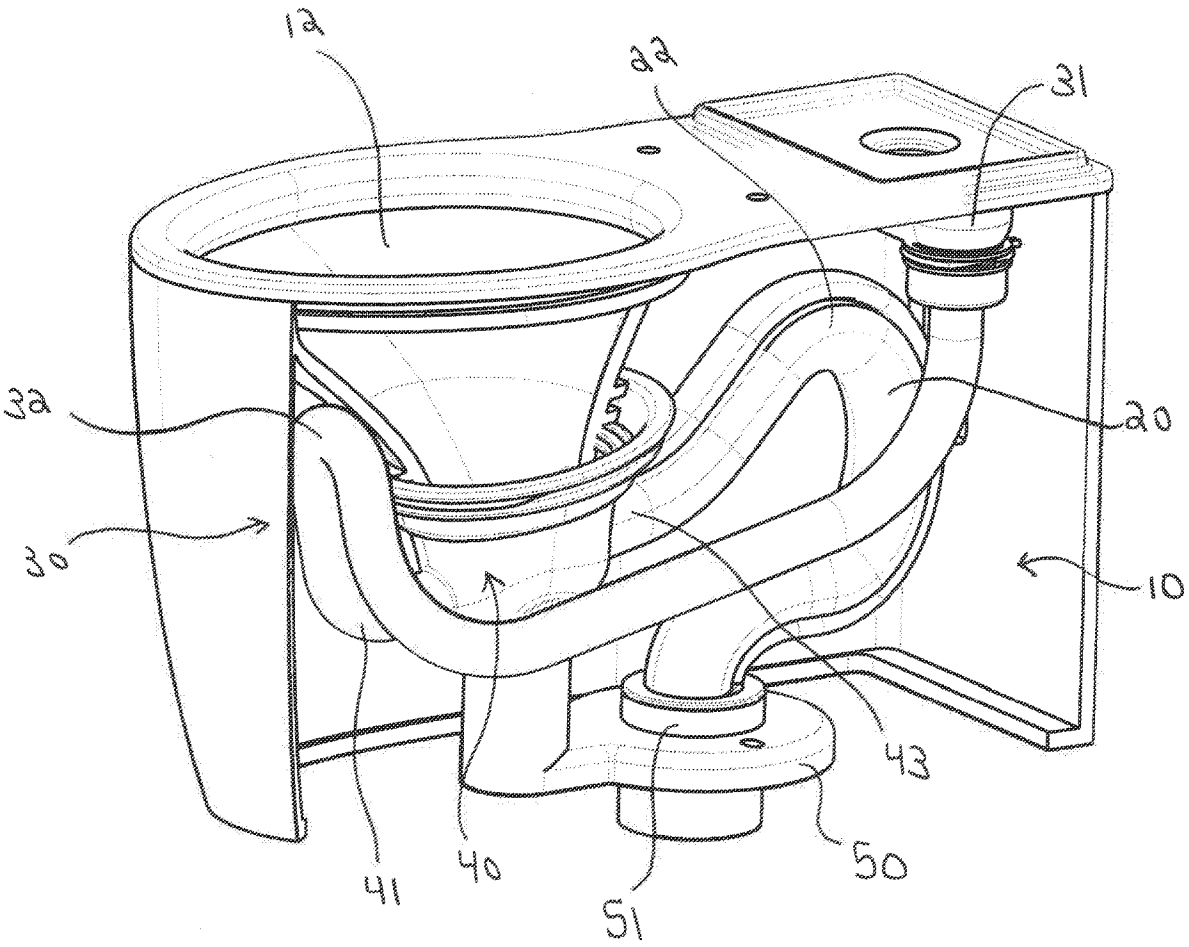
FIG. 1 is a forward perspective view of an exemplary embodiment of the herein disclosed jet-powered flushing system assembled with a toilet bowl.
Figure 2:
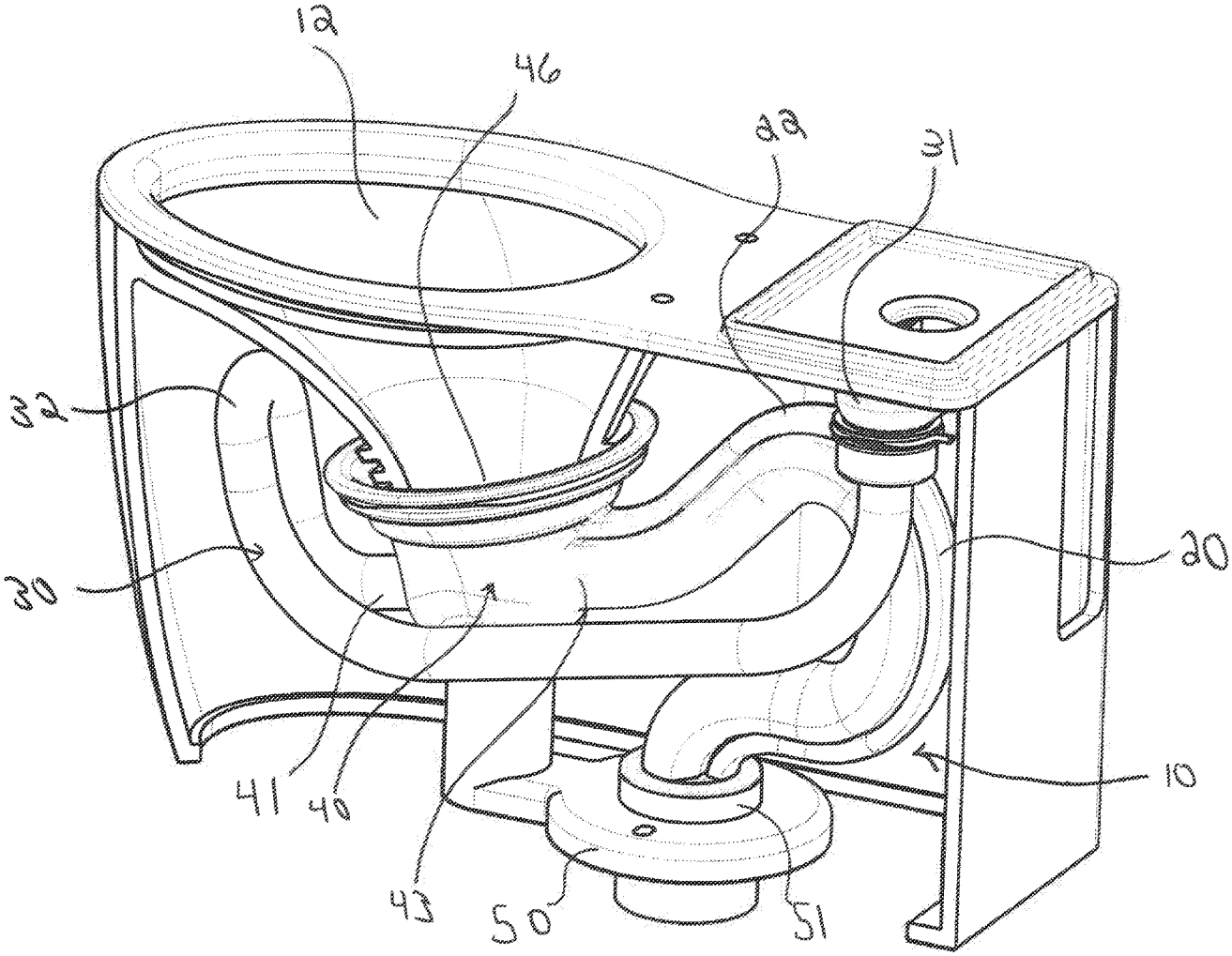
FIG. 2 is a rear perspective view of the embodiments of FIG. 1.

The disclosed solution can now be better understood turning to the following detailed description. It is to be expressly understood that the illustrated embodiments are set forth as examples and not by way of limitations on the embodiments as ultimately defined in the claims. FIGS. 1 and 2 depict related perspective views of one embodiment of the herein described novel modified trapway hydraulic flushing system 10 for assembly with an exemplary jet powered toilet 1. It can be seen that toilet 1 has corresponding bowl 12 that may be designed to receive contents such as liquid and/or solid waste and may therefore be in fluid communication with a toilet tank 214 (depicted in FIG. 9). Tank 214 may be positioned above or otherwise adjacent to bowl 12, wherein tank 214 is in fluid communication with bowl 12 through system 10.

As previously discussed, in typical siphonic toilets, a siphon jet can be used to transfer water with higher fluid pressure from tank 214 to the lower portion of bowl 12 to effectively push any static water in bowl 12, including liquid waste stored therein. For example, heretofore known siphon jets may effectively function as a jet pump to move the static water in bowl 12 through a trapway to initiate a siphon to clean bowl 12 during a flush cycle. After a particular flush cycle has terminated, any water remaining in the siphon jet may be drained away leaving the siphon jet filled with air. In typical siphonic toilets, however, this air volume must be pushed away before water can fill in the space occupied by the siphon jet again for the subsequent flush cycle. Thus, the siphon jet will require potential energy of the water column in tank 214 to push this air volume away. This process creates a delay in water that travels to bowl 12 before siphon-induced flow from the jet can again be initiated.

The herein disclosed system 10 provides a solution to substantially fill up the siphon jet space with water and avoid the described delay issues of typical siphonic toilets. System 10 may include jet trapway portion 30 that connects to the tank 214 in order to introduce water into system 10. Portion 30 may comprise a jet inlet 31 formed by a nozzle that directs flow of water from tank 214 and increases its flow velocity as it enters portion 30. Portion 30 may be formed by resilient or pliable tubing or a hose using materials such as plastic, rubber, or the like and may operatively connect to a lower portion of tank 214 through a secure engagement as discussed more particularly below.

Jet inlet 31 may be designed to adjust the velocity of water flowing from tank 214 through portion 30 to overcome a raised bend 32 of portion 30. Raised bend 32 may be formed from a generally upward loop including a U-shaped member. Portion 30 provides a sealed fluid bridge between tank 214 and a manifold 40 that may be operatively connected to bowl 12. It can be seen that manifold 40 receives portion 30 at an inlet 41 disposed below bend 32. Manifold 40 may be sealably connected to the underside of bowl 12 in a manner so that manifold 40 can receive any waste and/or liquids from bowl 12 and discharge them through an outlet 43 opposite inlet 41. It should be noted that outlet 43 may not be necessarily on the opposite side or surface of inlet 41 but may simply be positioned so that water flowing from portion 30 may be combined with contents flowing from manifold 40 and ultimately discharged out of manifold 40 through outlet 43. It should be understood that water flowing in portion 30 over bend 32 causes a siphon to form, wherein inlet 41 is designed so that it directs siphon-induced flow directly or indirectly at contents flowing from manifold 40 into outlet 43.

Downstream from outlet 43 may be waste trapway portion 20 that forms a fluid bridge and mounts to a drain line (not depicted). The drain line ultimately leads to a sewage line that receives discharged waste and other fluids from toilet 1. Portion 20 may therefore extend away from outlet 43 opposite portion 30 and may have a diameter or cross section relatively greater than portion 30. Portion 20 may be formed by resilient or pliable tubing or a hose using materials such as plastic, rubber, or the like and may operatively connect to a lower portion of drain line engagement 51 as discussed more particularly below.

As previously discussed, water flowing from portion 20 may be oriented towards outlet 43 and combined with contents flowing from bowl 12 into manifold 40. This combined flow may be oriented to overcome a raised bend 22 of portion 22 or portion 20 may optionally have a nozzle adjacent to or in communication with outlet 43. This nozzle would be designed to adjust the combined flow velocity out of outlet 43 sufficient to overcome 22 and into the drain line. In certain embodiments, bend 22 may be formed from a generally upward loop and preferably, a U-shaped member. It should be understood that water flowing in portion 20 over bend 22 causes a siphon to form, wherein the optional nozzle in communication with outlet 43 and/or combined flow through outlet 43 from portion 30 and manifold 40 forms siphon-induced flow to overcome bend 22 and ultimately be discharged through the downstream drain line.

Drain line engagement 51 may be formed from a waste flange, wax ring, or the like operable to be removably fastened to waste flange 51 that may be positioned in or upon the drain line. Note that system 10 does not require engagement 51 or flange 51 and may be directly engaged with the drain line itself.

Manifold 40 may comprise an upper portion that may have an integrally formed seal 46 or removably attachable seal 46 operable to sealably connect with a lower portion of bowl 12. Manifold 40 may also have a closed lower portion in communication with the upper portion through one or more perimetral walls surrounding jet trapway portion receiving inlet 41 and waste trapway portion receiving outlet 43. Manifold 40 may be formed from resilient material or pliable material operable to conform to different sized and/or shaped bowls 12. It is understood that manifold 40 and portions 20 and 30 may be integrally formed with each other as one single apparatus or may be removably attached to each other as separate, independent parts.

Figure 3:
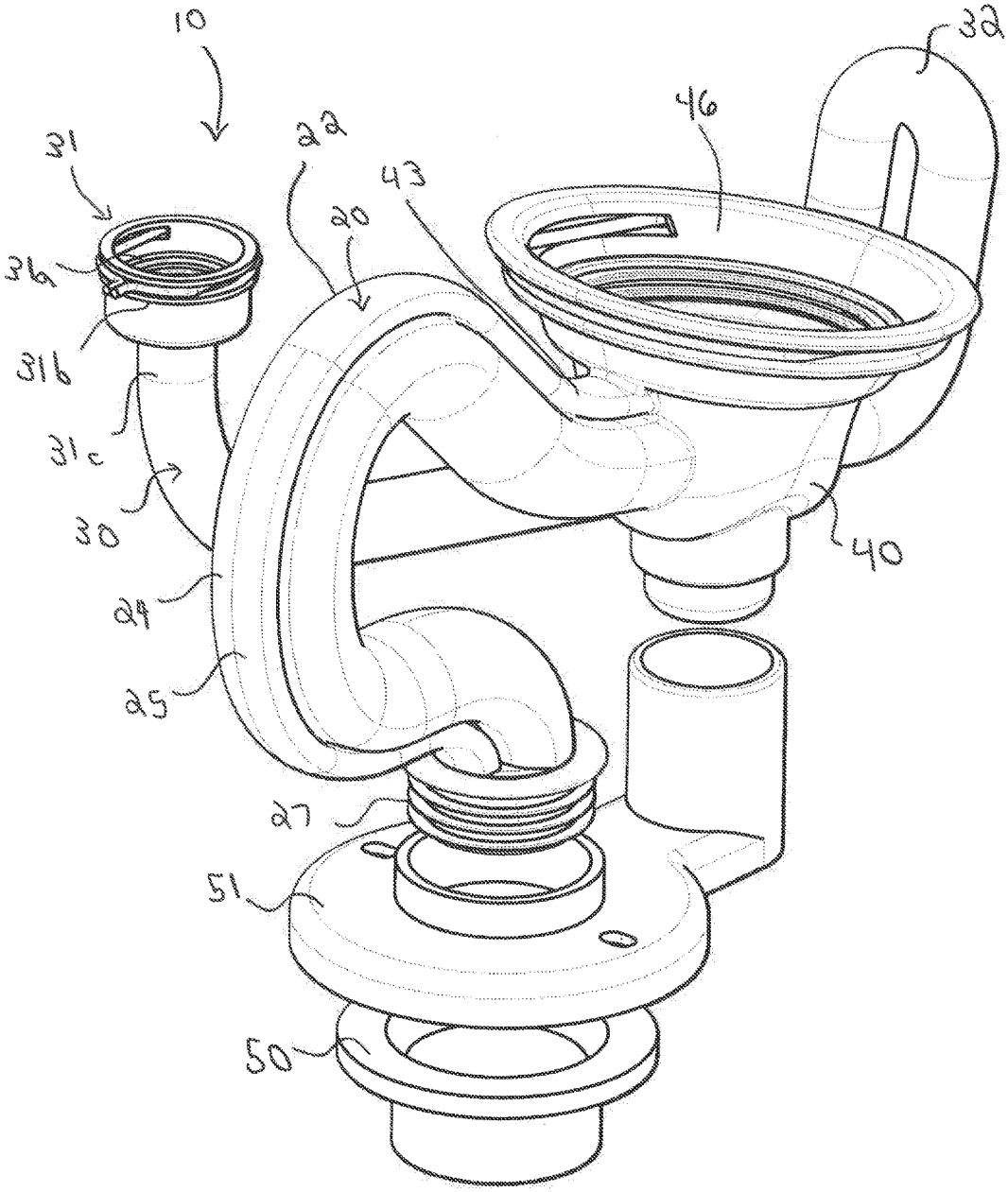
FIG. 3 is a close-up forward perspective view of certain features of an exemplary embodiment of the herein disclosed jet-powered flushing system.
Figure 4:
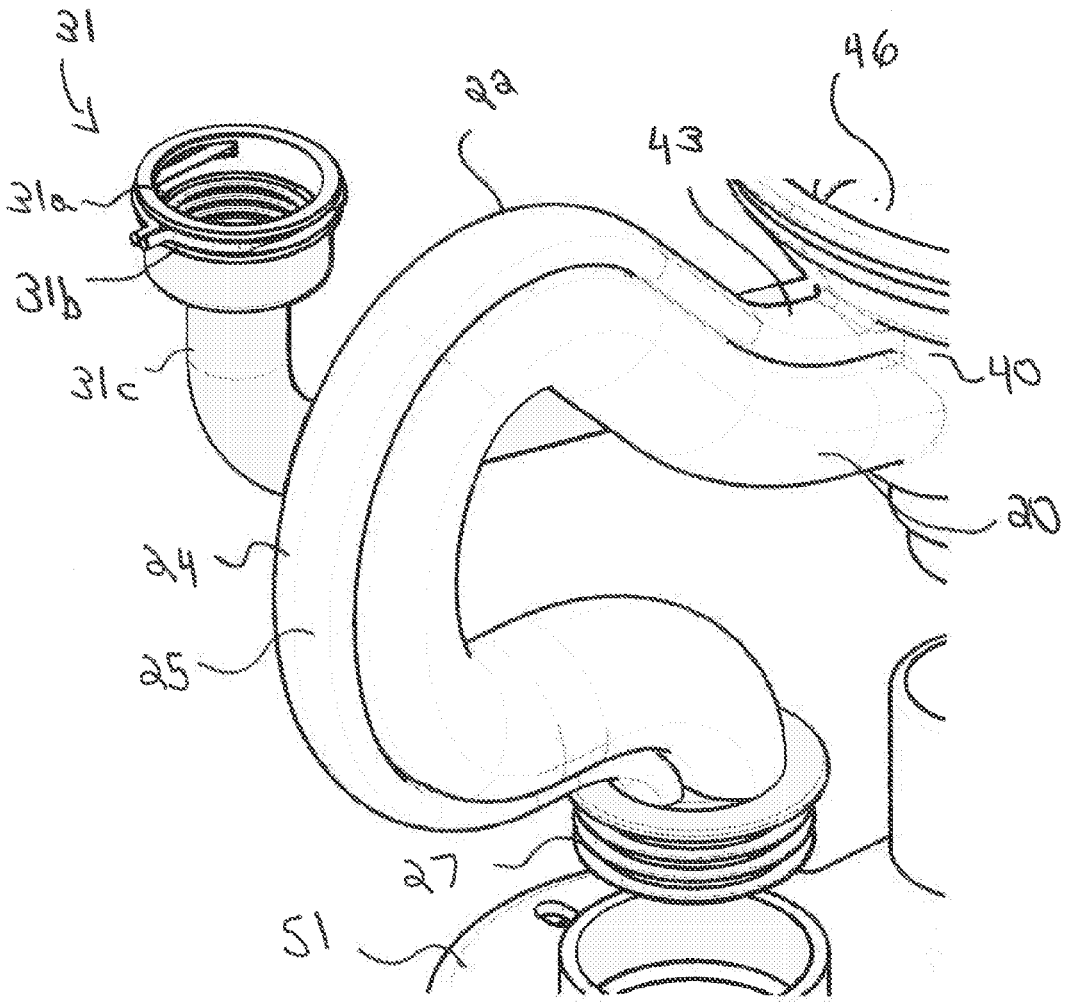
FIG. 4 is a close-up view of the embodiments of FIG. 3 more clearly depicting certain features of the jet and waste trapway portions of the jet-powered flushing system.
Figure 5:
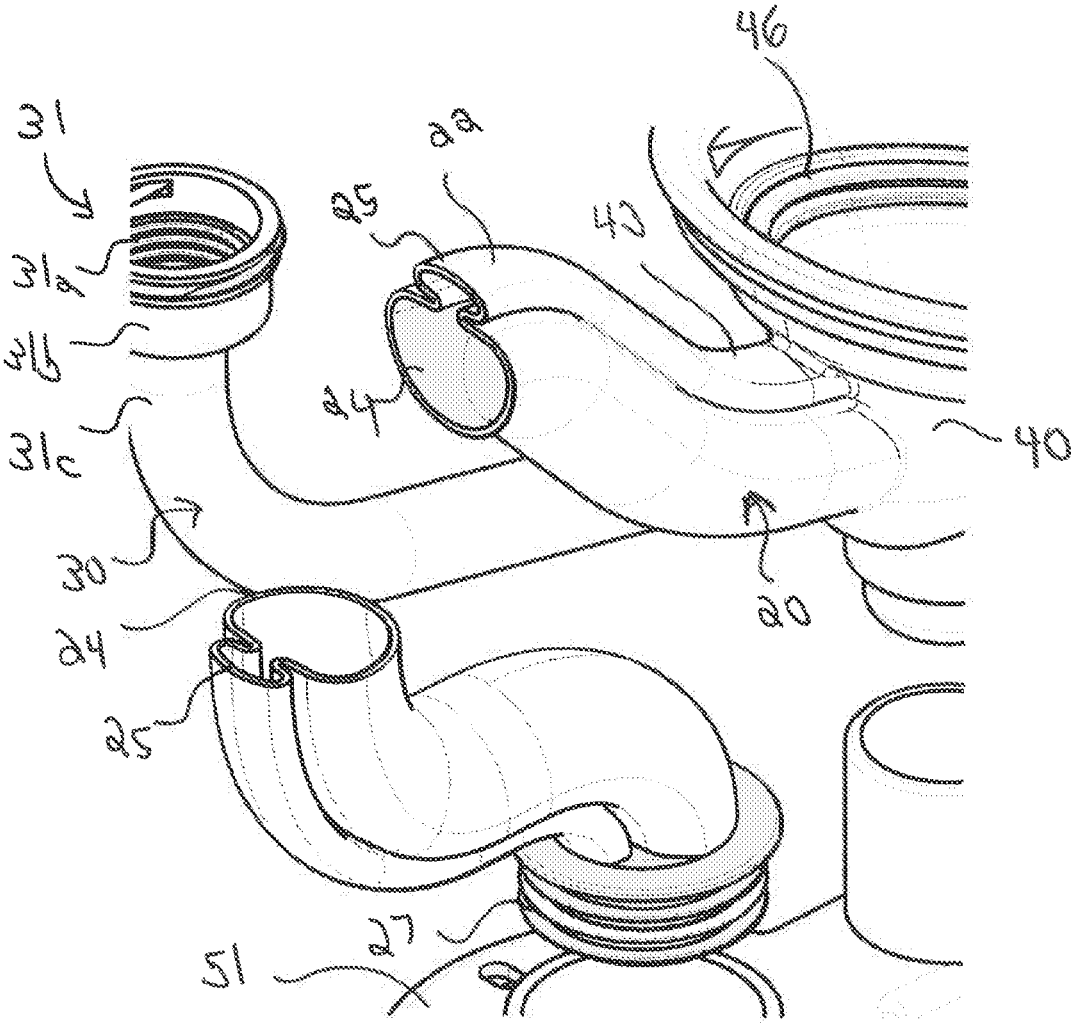
FIG. 5 is a close-up view of the embodiments of FIG. 3, wherein certain portions of the waste trapway portion have been removed to visualize exemplary primary and secondary channels of the waste trapway portion.

Turning to FIGS. 3 through 5 are related close-up views depicting certain features of system 10. In particular, it can be seen that engagement 31 of portion 30 may be formed by an internally sealed female connector 31*a*. Connector 31*a* may be comprise one or more internally molded seals operable to form a seal with corresponding male connector of tank 14 (not depicted). To secure the engagement between portion 30 and the male connector of tank 14, clamp system 31*b* may also be provided above jet 31*c* of engagement 31.

Similarly, portion 20 may operatively connect to engagement 51 and form a seal therewith through male connector 27 with one or more externally positioned seals received by female connector engagement 51 (which may be a wax ring). Connector 27 may therefore comprise one or more externally molded seals designed to form a seal with corresponding male female connector 51. It should be noted that the design is not so limited and either of engagement 31 or connector 27 may be female or male connectors with annular shoulders and/or mating flange surfaces depending on need or preference.

Turning between FIGS. 4 and 5 specifically, it is evident that portion 20 may comprise multiple channels including a primary channel 24 and a secondary channel 25. Channel 24 can be seen relatively larger than channel 25 and may be separated by a dividing auxiliary outlet or slit in portion 20 (see cross sections of FIG. 4). In other embodiments, this auxiliary outlet or slit may be replaced by a dividing screen, an array of integrally formed slits between channels 24 and 25, or any other manner of filtration to separate colloids or solid waste from liquids. In this respect, channel 24 and its relatively larger cross section may be designed to receive and discharge solid and liquid waste from manifold 40. In contrast, channel 25 may be designed for overflow conditions generally to discharge liquid waste with the majority of solid waste being restricted from flowing into channel 25 by the slit. Any number of channels 25 may be provided as needed or desired, wherein each of channels 25 are designed to generally discharged liquid waste and other liquids when/if channel 24 is clogged or backed up. In this respect, primary 24 and secondary 25 channels confer built-in overflow protection for system 10.

While FIGS. 3 through 5 depict portions 20 and 30 in communication with manifold 40 through integrally formed connections at inlet 41 and outlet 43, the design is not so limited. Instead, engagement at inlet 41 and/or 43 may be replaced with removable fastening mechanisms including hose clamps, male and female connector schemas, threaded fastener systems or even snap fit connectors.

Figure 6:
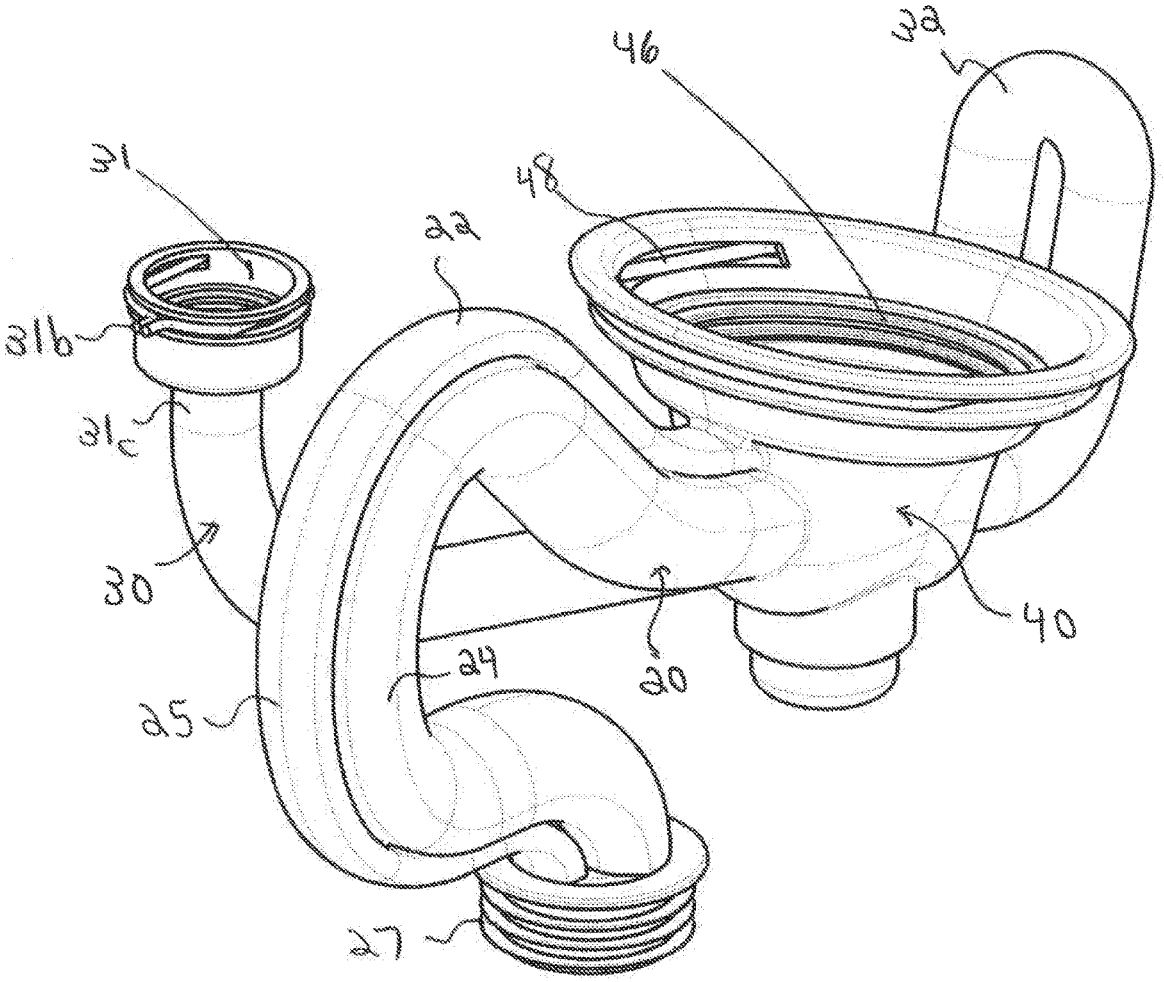
FIG. 6 is a close-up forward perspective view of certain features of an exemplary embodiment of the herein disclosed jet-powered flushing system more clearly depicting certain features of the manifold and jet and trapway portions.

FIG. 6 depicts a forward perspective view of a slightly modified system 10, wherein in this embodiment manifold 40 can now be seen comprising optional clamp 48 positioned on the internal surface of manifold 40. As can be seen, seal 46 may be integrally formed with the internal surface of manifold 40 or removably inserted therewith (e.g. as an O-ring or the like). In practice, manifold 40 may be removably attached to bowl 12 by being positioning the open upper portion of manifold 40 until seal 46 contacts bowl 12 and encircles the opening in the lower portion of bowl 12. Once positioned, manifold 40 may be securely engaged thereto using clamp 48. Clamp 48 in turn adjusts how tight the engagement may be with bowl 12 depending on design need or preference.

Figure 7:
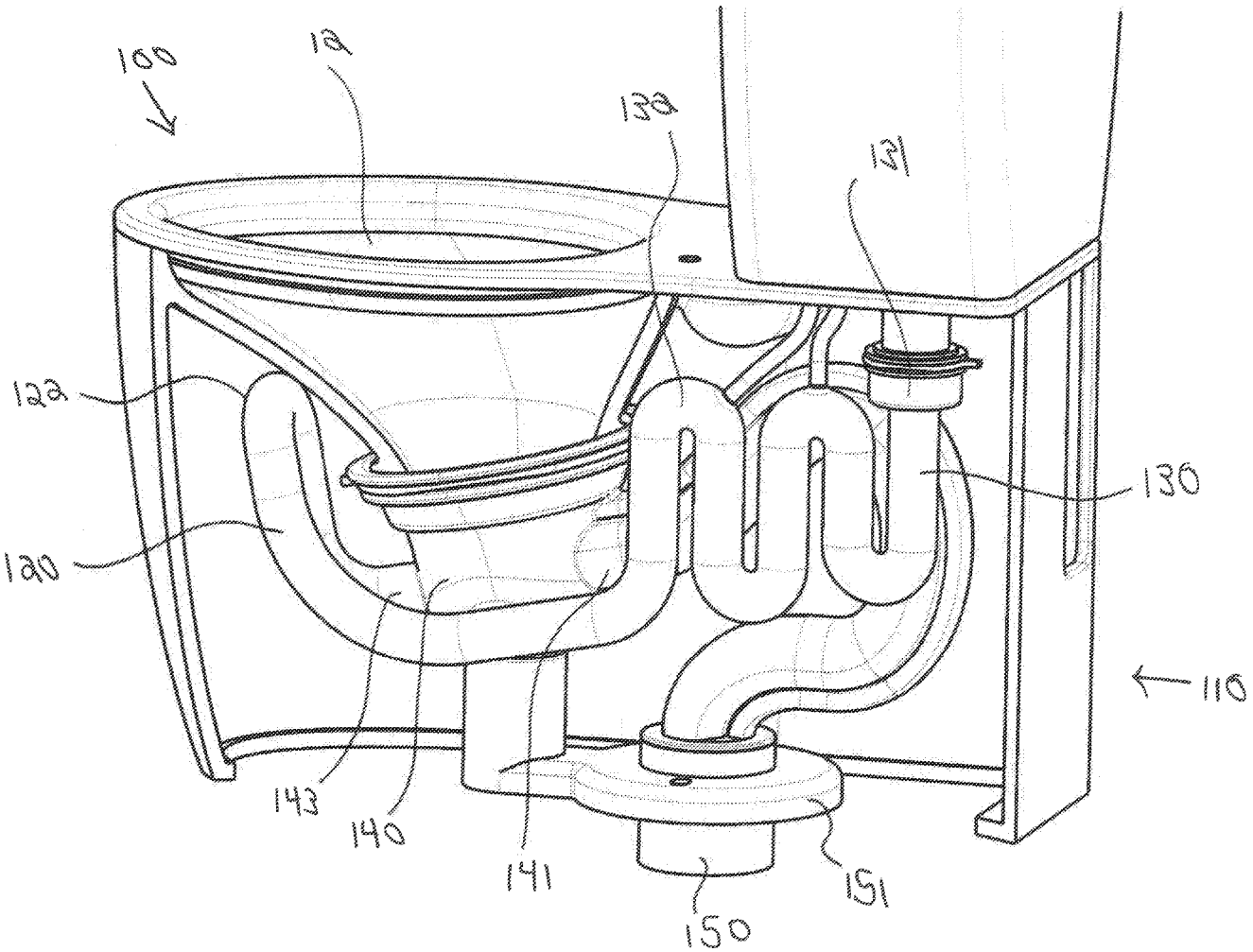
FIG. 7 is a rear perspective view of another embodiment of the herein disclosed jet-powered flushing system assembled with a toilet bowl.
Figure 8:
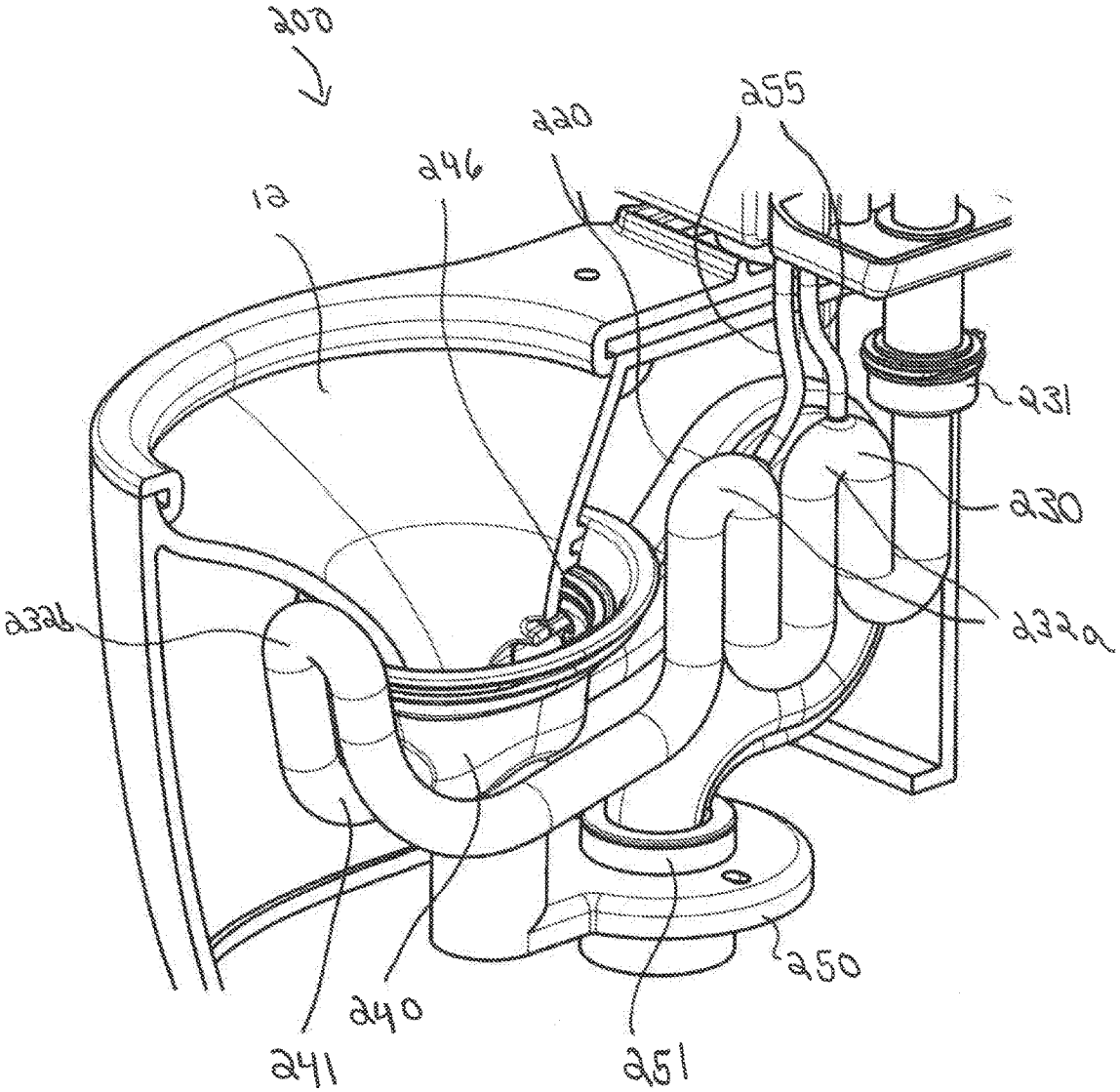
FIG. 8 is a forward perspective view of another embodiment of the herein disclosed jet-powered flushing system assembled with a toilet bowl and with a side cross section showing how the manifold seals to the bowl and certain features of the waste and trapway portions interconnect in the system.
Figure 9:
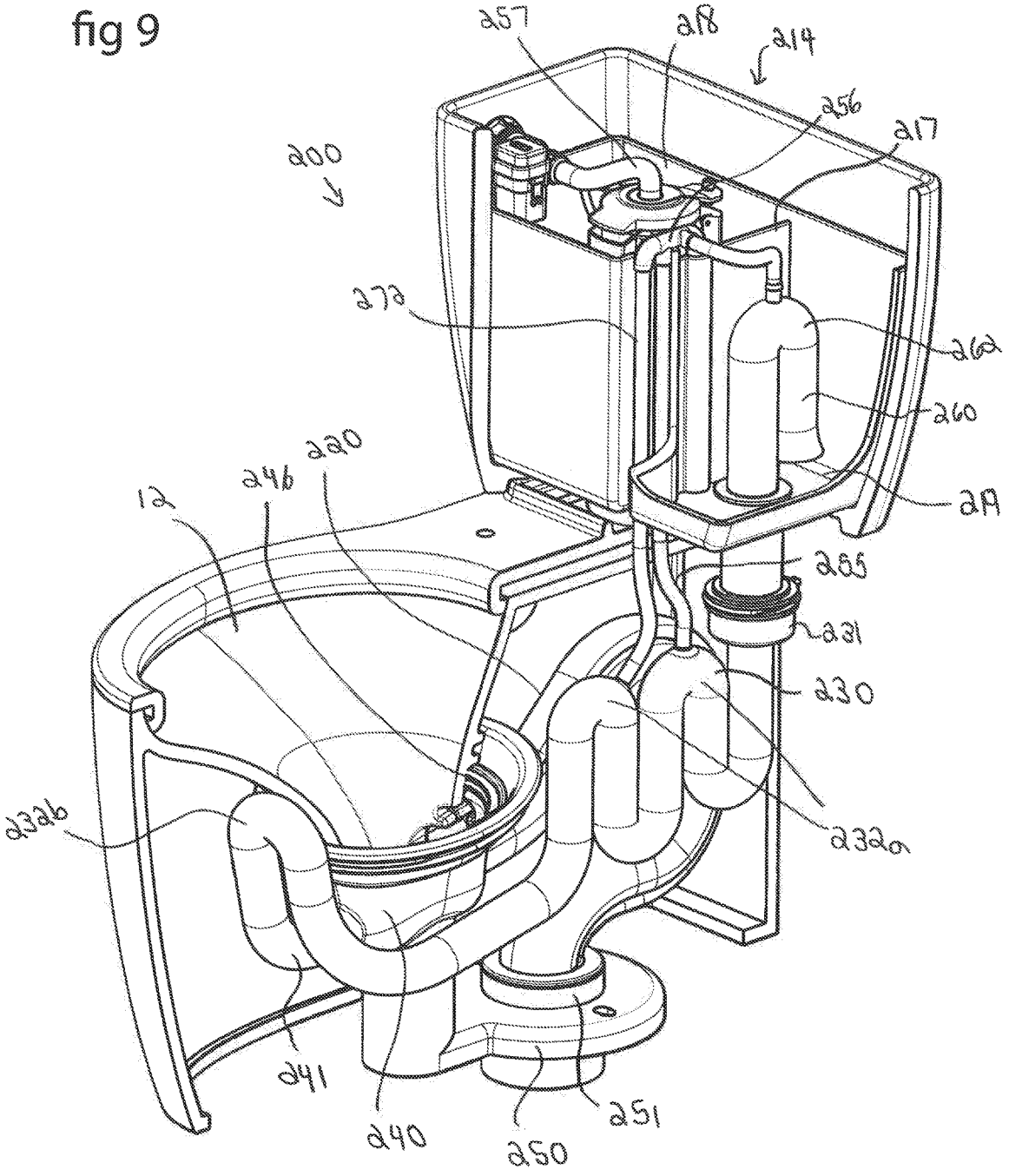
FIG. 9 is a forward perspective view of the embodiment of FIG. 8 mounted to a toilet tank separated into multiple chambers.

FIGS. 7 through 9 depict modified trapway systems of the previously described system 10, wherein it should be noted that features with similar numeric designations (e.g. system 10, 110, 210) correspond to modified versions of previously described features in FIGS. 1-6. Accordingly, FIG. 7 depicts a rear perspective view of system 110 with jet trapway portion 130 having bend 132. Instead of portion 30 forming a rear positioned trapway that extends away from engagement 31 around manifold 40 as in previous embodiments, portion 130 forms bend 132 and corresponding generally upright loop and attaches to or otherwise communicates with inlet 141 of manifold 140 without extending passed the same. In other words, portion 130 forms a forward positioned trapway with jet of engagement 31. In embodiments described in FIGS. 1-7, however, respective jets of portions 30 and 130 each still cause to prime fluids flowing therethrough to overcome associated bends 32 or 132 prior to entry in manifold 140.

FIGS. 8 and 9 depict another embodiment of jet flushing system 210 for use completing a flush cycle flushing toilet 200. It can be seen that system 210 comprises a modified rear positioned jet trapway portion 230 having multiple bends 232*a* with corresponding generally upward loops. The generally upward loops of system 210 and previously described systems 10 and 110 of respective jet trapway portions 230, 30, and 130 form one or more air locks therein. These air locks function to retain water inside respective jet trapway portions from draining away into corresponding manifolds. In this respect, the one or more air locks occupy less volume than is available in the jet trapway portion itself.

Preferably, bends 232*a* and corresponding generally upward loops may receive one or an array of venting tubes 255, depending on the number of bends 232*a* of system 210, in fluid communication with air locks of bends 232*a*. Tubes 255 in turn may vent air away from portion 230 to atmosphere while water in a flush cycle is entering the jet space from corresponding tank 214. This is particularly advantageous as tubes 255 permit a reliable and strong siphon jet to be formed relatively quickly. Advantageously, no energy is wasted during use for pushing the air in the jet space of portion 230 as in conventional siphonic toilets in use prior to the herein disclosed novel solution.

FIG. 9 depicts the system 210 of FIG. 8 in communication with a modified tank 214. Tank 214 may be modified through inclusion of partition 217 which divides tank 214 into multiple compartments. In a preferred embodiment, partition 217 divides tank 214 into first compartment 218 and a second compartment 219. Partition 217 may be removably attached to tank 214 in any manner including slidably received therewith through a guide, sleeve, or receiver. Partition 217 may alternatively be removably attached through one or more fastening mechanisms operable to securely engage partition 217 at a desired orientation and location in tank 214. Partition 217 may also be integrally formed with tank 214. It should be noted that any number of partitions 217 may be comprised by tank 214.

Preferably, compartment 218 houses a fill valve to refill tank 214 and a flush valve in fluid communication with bowl 12 and operatively connected to an externally accessible activator switch (e.g. a flush lever) operable to receive input from a user to activate a flush cycle. Water stored in compartment 218 may therefore be delivered through the flush valve to the rim of bowl 12 in a manner sufficient to wash said rim. Depending on design needs, compartment 218 may be designed to store any amount of water but preferably be sufficiently sized to impart flushes of at least 1.2 gallons.

By contrast, compartment 219 receives and houses water for delivery to system 210 through portion 230. During a flush cycle, as water fills compartment 218 through its fill valve, water will fill compartment 218 until rising water levels cause water to be supplied to compartment 219 over partition 217. As such, water from compartment 218 will fill up tank 214 in each of its compartments until a predetermined level in tank 214 is obtained whereby the fill valve of compartment 218 will cease filling. The preferred predetermined height may therefore by adjacent to the height of partition 217 or it may be any level above partition 217 but below the lid of the tank. Alternatively, compartment 219 may be in fluid communication with an independent water supply line separate from compartment 218 and its fill valve. Compartment 219 may be in fluid communication with portion 230 through jet inlet 231. Preferably, compartment 219 delivers water to portion 230 through a jet intake 260 internally positioned in compartment 219. Intake 260 is therefore in fluid communication with portion 230.

Intake 260 may be constructed from a generally upright member with a raised bend 262, wherein intake 260 may have an inlet with a nozzle oriented to face the lower surface of compartment 219. Similar to bends 232*a*, bend 262 may be designed to form one or more air locks operable to retain water from draining into portion 230. Preferably, intake 260 may be a generally upright U-shaped member wherein a siphon may be formed inside intake 260 causing water to be drawn through the inlet of intake 260 and into portion 230.

In some embodiments, previously described ventilation tube(s) 255 may pass from respective bends 232*a* of portion 230 through an air manifold 256 internal to tank 214 and may terminate at bend 262 of intake 260. If there are multiple tubes 255, then manifold 256 may comprise a single outlet through which an outlet tube or hose of tubes 255 fluid may be communicated to bend 262. Manifold 256 may be connected to a tube 272 having one or more apertures in fluid communication with ambient air including a single end opening. The one or more apertures may be positioned at a predetermined height in compartment 218. Though it is preferred to position manifold 256 and its associated one or more apertures upon, adjacent to, above, or otherwise near the upper portion of partition 217, system 210 is not so limited. Optionally, manifold 256 may be positioned in compartment 218 or 219, as needed or required, and manifold 256 may be designed to receive one or multiple incoming tubes 255 and deliver a single or multiple tubes to bend 262 as needed or required.

In practice, when a flush is initiated using toilet 200 with system 210 through the externally accessible activation mechanism, the flush valve in the first compartment is opened to let water drain to the rim of bowl 12. When the water level in compartment 218 dropped below the tube opening of manifold 256, any compressed air in air locks of intake 260 may be caused to vent to atmosphere. This is particularly advantageous as it permits water in compartment 219 to automatically flow through intake 260 and corresponding bend 262. This is because a siphon is formed inside intake 260 that causes water in compartment 219 to be drawn through intake 260 to be delivered to and fill up corresponding portion 230. In turn, bowl 12 will also initiate its siphon to flush and thus discharge any contents in bowl 12, including liquid or solid waste, through outlet 243 of manifold 240.

The water volume that may be delivered to the rim of bowl 12 from compartment 218 and water volume that may be delivered to the jet trapway portion 230 may therefore be controlled by the starting, predetermined water level in tank 214 and the residual water level in compartments 218 and 219. In a preferred embodiment, system 210 may comprise a preferred sequence for system activation operable to supply water to jet trapway portion 230 and its jet after water from compartment 218 is delivered to the rim and starts to fill up bowl 12. In those embodiments including this novel system activation sequence, this timing may be relatively important to establish strong siphon in system 210 including portions 230 and 220 which are in communication with bowl 12 all while maintaining a minimum loss of water from initial activation.

Tank 214 with its divided compartments is also advantageous as it ensures that each compartment remains relatively independent. This is important, for example, if there is a backflow from portion 230 that results from a plunging action in bowl 12 to resolve a clogging issue. System 210 as described may permit dark water to only enter compartment 219 as opposed to otherwise contaminating compartment 218 where the fill valve, flush valve, and other features reside. This novel solution is also compliant with relevant anti-siphon code requirements for the fill valves as it relates to different downstream conditions. Because compartment 218 is incapable of being contaminated by backflow, features housed by compartment 218 including the fill valve may be both easier to construct in its confined place as well as easier to maintain which leads to longer system design life.

The herein described novel systems 10, 110, and 210 are also advantageous as they provide for increased design freedom for other features of the toilet including bowl 12 since respective jet trapway portions and waste trapway portions of each system 10, 110, and 210 are now independent from bowl 12. In turn, this reduces the likelihood that bowl 12 can crack, fracture, or otherwise succumb to wear and tear as a result of the now relatively lighter weight and less complicated structure associated with systems 10, 110, and 210. Installation of either of systems 10, 110, 210 with corresponding bowl 12 and its toilet tank is therefore enhanced which reduces previously associated labor costs ascribed to installation.

Many alterations and modifications may be made by those having ordinary skill in the art without departing from the spirit and scope of the embodiments disclosed and described herein. Therefore, it is understood that the illustrated and described embodiments have been set forth only for the purposes of examples and that they are not to be taken as limiting the embodiments as defined by the following claims. For example, notwithstanding the fact that the elements of a claim are set forth below in a certain combination, it must be expressly understood that the embodiments include other combinations of fewer, more or different elements, which are disclosed above even when not initially claimed in such combinations.

The definitions of the words or elements of the following claims are, therefore, defined in this specification to not only include the combination of elements which are literally set forth. It is also contemplated that an equivalent substitution of two or more elements may be made for any one of the elements in the claims below or that a single element may be substituted for two or more elements in a claim. Although elements may be described above as acting in certain combinations and even initially claimed as such, it is to be expressly understood that one or more elements from a claimed combination can in some cases be excised from the combination and that the claimed combination may be directed to a subcombination or variation of a subcombination(s).

Insubstantial changes from the claimed subject matter as viewed by a person with ordinary skill in the art, now known or later devised, are expressly contemplated as being equivalently within the scope of the claims. Therefore, obvious substitutions now or later known to one with ordinary skill in the art are defined to be within the scope of the defined elements. The claims are thus to be understood to include what is specifically illustrated and described above, what is conceptually equivalent, what can be obviously substituted and also what incorporates the essential idea of the embodiments.

What has been described above includes examples of one or more embodiments. It is, of course, not possible to describe every conceivable combination of components or methodologies for purposes of describing the aforementioned embodiments, but one of ordinary skill in the art may recognize that many further combinations and permutations of various embodiments are possible. Accordingly, the described embodiments are intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A hydraulic flushing system for a toilet, the system comprising:

a jet trapway portion having a jet inlet with a nozzle fluidly communicable with a tank of the toilet, the nozzle directing water from the jet inlet to overcome a bend in the jet trapway portion;

a toilet bowl manifold receiving the jet trapway portion at an inlet below the bend of the jet trapway portion, the manifold sealably connectable to a toilet bowl of the toilet; and a waste trapway portion extending away from an outlet of the manifold and fluidly communicable with a drain line downstream of the toilet;

wherein contents are discharged from the bowl through the manifold by combining siphon-induced water flowing into the manifold from the jet trapway portion with contents flowing from the manifold into the waste trapway portion thereby overcoming a bend in the waste trapway portion positioned above an outlet of the manifold.

2. The system according to claim 1, wherein the jet trapway portion, the manifold, and the waste trapway portion are integrally formed with each other.

3. The trapway system according to claim 1, the waste trapway portion further comprises:

a primary channel for discharging waste; and at least one secondary channel for discharging liquids, the at least one secondary channel being smaller than the primary channel.

4. The system according to claim 3, wherein the primary and secondary channels are partially connected through an auxiliary outlet or a slit operable to obstruct solid waste or colloids but permit ingress of liquids.

5. The system according to claim 4, wherein the primary and secondary channels are integrally formed with each other.

6. The system according to claim 1, wherein the manifold further comprises:

an upper portion with a seal operable to sealably connect with a lower portion of the toilet bowl; and a closed lower portion in communication with the upper portion through one or more perimetral walls, the closed lower portion having the inlet receiving the jet trapway portion and the outlet of the waste trapway portion.

7. The system according to claim 1, wherein the bend of the jet trapway portion is formed by a first generally upward loop having one or more air locks to retain water from draining into the manifold.

8. The system according to claim 7, wherein the one or more airlocks occupy less volume than is available inside the jet trapway portion.

9. The system according to claim 7, the jet trapway portion further comprising one or more additional generally upward loops each having a bend above the inlet to the manifold and one or more associated air locks to retain water from draining into the manifold.

10. The system according to claim 7, the jet trapway portion further comprising a ventilation tube extending from the first generally upward loop in fluid communication with the one or more air locks.

11. The system according to claim 10, wherein the ventilation tube is integrally formed with or removably attached to the first generally upward loop.

12. The system according to claim 10, wherein a proximal portion of the ventilation tube is adjacent to the first generally upward loop and a distal portion of the ventilation tube is in communication with ambient air.

13. A method of flushing a toilet with a trapway system, the method comprising:

sealably connecting a manifold of the trapway system to a lower portion of a toilet bowl;

mounting a jet trapway portion of the trapway system to a toilet tank, the jet trapway portion having a jet inlet with a nozzle in fluid communication with the toilet tank to supply water to the jet trapway portion during a flush cycle;

directing water from the jet inlet of the jet trapway portion to overcome a bend in the jet trapway into an inlet of the manifold disposed below the bend; and discharging waste from the bowl through the manifold to a drain line through a waste trapway portion of the trapway system, wherein waste is discharged by combining siphon-induced water flowing from the jet trapway portion into the manifold with waste flowing from the manifold into the waste trapway portion thereby overcoming a bend in the waste trapway portion positioned above an outlet of the manifold.

14. The method according to claim 13, wherein the manifold receives waste from the toilet bowl, and wherein the siphon-induced water flow and waste flow are combined by orienting flow from the jet trapway portion towards the outlet of the manifold where waste flow is being discharged through the outlet.

15. The method according to claim 13, the waste trapway portion further comprising a primary channel for discharging waste and at least one secondary channel for discharging liquids, the at least one secondary channel being smaller than the primary channel and being separated by a slit or auxiliary outlet defined between the primary and secondary channels, the method further comprising:

discharging solid and liquid waste through the primary channel, wherein solid waste or colloids are obstructed by the slit or auxiliary outlet from entering the at least one secondary channel; and discharging substantially only water and liquid waste through the at least one secondary channel.

16. A hydraulic flushing system, the system comprising:

a tank operable to receive water;

a bowl in communication with the tank, wherein water is delivered from the tank to the bowl to discharge waste in the bowl through a manifold operatively connected thereto and into a drain line;

a jet trapway portion having a jet inlet with a nozzle in fluid communication with the tank of the flushing system, the nozzle directing water from the jet inlet to overcome a bend in the jet trapway portion, wherein the jet trapway portion is received by the manifold at an inlet below the bend of the jet trapway portion;

a waste trapway portion extending away from an outlet of the manifold opposite the jet trapway portion and in fluid communication with the drain line;

wherein waste contained in the manifold is caused to be discharged by combining siphon-induced water flowing from the jet trapway portion into the manifold with waste flowing from the manifold into the waste trapway portion thereby overcoming a bend in the waste trapway portion positioned above an outlet of the manifold.

17. The system according to claim 16, the tank being separated into first and second compartments by a partition;

the first compartment comprising water to complete a flush cycle, a flush valve to deliver water to the bowl during the flush cycle, and a fill valve to refill the tank; and the second compartment in fluid communication with the jet trapway portion, the second compartment comprising a jet intake to distribute water in the second compartment to the jet trapway portion.

18. The system according to claim 16, wherein the fill valve closes when water in the tank is at a predetermined water level above or adjacent to an upper portion of the partition.

19. The system according to claim 16, wherein the jet intake is an upright U-shaped member having an inlet disposed adjacent to a lower surface of the tank.

20. The system according to claim 19, wherein the bend of the jet trapway portion is formed by a first generally upward loop having one or more air locks to retain water from draining into the manifold, the jet trapway portion further comprising a ventilation tube extending from the first generally upward loop in fluid communication with the one or more air locks.

21. The system according to claim 20, wherein the ventilation tube extends from the jet trapway portion until operatively connecting to an inlet of the upright U-shaped member.

22. The system according to claim 21, wherein the ventilation tube passes through an air manifold adjacent to, nearby, or on an upper portion of the partition.

23. The system according to claim 22, wherein a proximal portion of the ventilation tube is adjacent to the first generally upward loop of the jet trapway portion and a distal portion of the ventilation tube is in communication with an ambient air aperture of the air manifold.

24. The system according to claim 22, the jet trapway portion further comprising one or more additional generally upward loops each having a bend above the inlet to the manifold and one or more associated air locks in communication with an associated ventilation tube extending from associated generally upward loops to retain water from draining into the manifold.

* * * * *